United States Patent [19]

Galnbek et al.

[11] 4,140,521

[45] Feb. 20, 1979

[54] METHOD OF CONTINUOUSLY CONVERTING METALLURGICAL MELTS

[76] Inventors: Arnold A. Galnbek, 2 Murinsky prospekt, 10, kv. 150; Dmitry A. Diomidovsky, Kuznetsovskaya ulitsa, 44, kv. 174; Len M. Shalygin, pereulok Kakhovskogo, 4, kv. 40; Igor A. Juzhaninov, Bolshoi prospekt, 89, kv. 24; Boris F. Verner, Detskaya ulitsa, 26, kv. 10; Sergei D. Sheremetiev, naberezhnaya Fontanki, 50, kv. 5, all of Leningrad; Yakov K. Osipov, Gvardeisky prospekt, 13, kv. 16, poselok Nikel Murmanskoi oblasti; Valentin I. Mikhailov, ulitsa Pobedy, 23, kv. 2, V. Ufalei Chelyabinskoi oblasti, all of U.S.S.R.

[21] Appl. No.: 767,033

[22] Filed: Feb. 9, 1977

Related U.S. Application Data

[63] Continuation of Ser. No. 325,435, Jan. 22, 1973, abandoned, which is a continuation of Ser. No. 132,427, Apr. 8, 1971, abandoned.

[51] Int. Cl.[2] ..... C21B 3/00; C21C 1/00

[52] U.S. Cl. ..... 75/46

[58] Field of Search ..... 75/46

[56] References Cited

U.S. PATENT DOCUMENTS

| | | | |
|---|---|---|---|
| 3,437,475 | 4/1969 | Themelis | 75/76 |
| 3,554,519 | 1/1971 | Kerlie | 75/52 |
| 3,561,952 | 2/1971 | Greenberg | 75/76 |
| 3,617,257 | 11/1971 | Rouanet | 75/46 |
| 3,634,065 | 1/1972 | Worner | 75/46 |
| 3,701,519 | 10/1972 | Vayssiere | 75/46 |
| 3,702,675 | 11/1972 | Rouanet | 75/46 |
| 3,865,579 | 2/1975 | Williams | 75/46 |
| 3,985,549 | 10/1976 | Rehinlanden | 75/46 |

*Primary Examiner*—P. D. Rosenberg

*Attorney, Agent, or Firm*—Holman & Stern

[57] ABSTRACT

The method of the present invention provides for blasting a melt with a gaseous oxidizer in a furnace bath having a greater depth in zones of oxidative blasting and slag formation, and a lesser depth in a zone of slag separation, the bath depth in the slag separation zone equaling 0.3–0.8 of that in the blasting zone.

3 Claims, 3 Drawing Figures

METHOD OF CONTINUOUSLY CONVERTING METALLURGICAL MELTS

This is a continuation of application Ser. No. 325,435, filed Jan. 22, 1973 now abandoned which in turn is a Rule 60 Continuation of U.S. Ser. No. 132,427, filed Apr. 8, 1971, now abandoned.

BACKGROUND OF THE INVENTION

The present invention relates to methods of continuously converting metallurgical melts, such as copper and nickel mattes, ferronickel, etc.

Known in the art is a method of continuously converting metallurgical melts by blowing them through with a gaseous oxidant in the bath of a converter furnace. The starting melt and the flux are delivered into the bath, and in successively formed zones of oxidative blasting, slag formation, and slag separation a process is realized resulting in the formation of a concentrated product and slag, which are separately tapped through holes available in the bath. Also known is a converter furnace for realizing such method, in whose roof tuyeres are mounted to feed the gaseous oxidizer, which are located at an angle of 60–80° to the horizontal (USSR Inventors Certificate No. 120,646).

In this conventional converter furnace the bath has a constant depth, and the oxidizer is fed thereinto at a pressure of 4–6 atm through the tuyeres, whose nozzles are spaced 350–400 mm from the melt level in the bath, thus providing for the penetration of the oxidizer to a depth sufficient to mix the melt in the oxidative blasting zone, but not resulting in movement of the mass of the melt.

In accordance with the foregoing method of converting, the oxidizer, the flux, and the melt are fed into the front part of the furnace, the slag and the concentrate being tapped from the slag separation zone in the rear part of the furnace.

The heat transfer to the slag separation zone is effected mainly due to movement of the concentrated mass from the blasting zone, so that thermal stabilization in the zone of slag separation is only possible with the described way of discharging the concentrate and feeding the starting melt.

The starting melt must be delivered to the front part of the furnace to prevent the concentrated product from being diluted with the starting melt.

In the previous method the melt circulation is most intense in the front part of the furnace, and it is in this part that the melt is being actively treated by the oxidizer and the flux. However, due to the constant depth of the bath, and supply of the gaseous oxidizer in the direction of the slag separation zone, there occurs attenuation of the melt circulation, with movement of the melt in the end of this zone taking place only on account of drainage of the process products. As a result, the transfer of heat released in the oxidative blasting zone to the zone of slag separation is not secured to a sufficient extent, so that the temperature in the slag separation zone is lowered, which impedes separation of the slag and its drainage, and causes incrustations.

The low mobility of the melt in the slag separation zone does not promote isolation of its mechanical inclusions from the slag, and lowers the efficiency of the converter slag depletion.

The need to charge the flux directly into the oxidative blasting zone, resulting from poor assimilation of flux beyond this zone because of insufficient melt circulation, involves operational inconveniences including clogging of the flux spouts by the melt splashes, and the requirement to use flux of a definite grain-size composition so as to prevent it from being carried away by the exhaust gases.

In producing a conditioned product, its discharge in the end of the furnace, combined with the indispensable period of metal concentrations in the converting mass across the furnace length, which is due to the slag interaction with the concentrate, result in the need to reblow the melt in the oxidative blasting zone. Reblowing the melt increases metal losses in the slag.

In addition, due to the concentrate being discharged in the end of the furnace, the exchange reactions between the slag and the mass of the melt within the slag separation zone conform to the equilibrium composition of a rich mass, which makes effective depletion of the impossible slag.

All the cited disadvantages deteriorate the characteristics of the converting process.

Employment of the previous method is limited to its preferable use for obtaining an intermediate concentrate requiring further treatment.

SUMMARY OF THE INVENTION

An object of the present invention is to eliminate the above disadvantages.

The basic object of the invention is to provide a method of converting metallurgical melts that will provide intense circulation of the melt all along the bath.

In accordance with the invention, the melt converting is realized in a bath whose depth in the zone of slag separation is less than that in the zones of oxidative blasting and slag formation, and the gaseous oxidizer is fed into the melt in the direction of the slag formation zone, the pressure of the oxidizer at the melt level being 2–10 atm, thus securing the melt movement in a vertically closed flow, while the flux is fed into the slag formation zone. With such a method the starting melt is fed between the zone of slag formation and the slag separation zone, thus washing the slag through, while the concentrated product is tapped from the bottom of the deep section of the bath.

Due to the organization of a directed melt movement in a closed flow, this makes possible pouring the concentrate directly from the blasting zone, and feeding the starting melt between the zones of slag formation and slag separation. As a consequence, the melt in the slag separation zone is lean as compared to the concentrated product, which provides more favorable equilibrium conditions for slag separation and its depletion.

The feed of the starting melt that effects slag washing, permits the obtaining of additional slag depletion. The concentrate tapping from the oxidative blasting zone eliminates the need for reblowing the melt.

Intense circulation of the melt in the slag separation zone provides for thermal stability and sufficiently high temperature value in this zone. Effective flux assimilation at the rear of the oxidative blasting zone, which is secured by the melt circulation, makes it possible to charge the flux into the slag formation zone, and thus eliminate the operational inconveniences during flux charging, and also to use fluxes of a wide grain-size composition.

It is expedient, that by means of the melt flow, and by uniform flux charging into the slag formation zone, a continuous flux layer be produced in the slag separation zone, and that the slag be drained from under this layer.

A continuous flux layer promotes thermal stabilization of the slag separation zone, and a more complete saturation of the flux with slag.

It is also advisable, that the converting process be realized in a bath having an overflow sill at the junction of its depths, thus forming two closed flows of the converting melt forward of, and behind, the sill, these flows exchanging with each other through the general flow of melt circulation in the bath, and that a gaseous reagent be fed into this flow behind the overflow sill and forward of the slag separation zone, in the direction of the general melt flow. Such realization of the method permits raising the intensity of the melt circulation in the slag formation zone, and retaining in this zone the lean starting melt, thereby effecting still more complete depletion of the converter slag.

The converter furnace for realizing the proposed method has a bath of varying length with a ratio of its depth in the slag separation zone being 0.3–0.8 of that in the oxidative blasting and the slag formation zones, while the tuyeres for feeding the gaseous oxidizer are located over the deeper section of the bath, and are directed toward its shallower section. The holes for tapping the concentrate are disposed at the bottom of the deeper section of the bath, and the holes to feed the starting melt are located over its shallow section nearer to the junction of depths of the bath.

Such a converter furnace secures organization of a directed vertically closed flow of the melt.

A converter furnace to form two closed flows exchanging through a general flow of melt circulation can have an overflow sill positioned at the junction of depths, and having in the shallow section of the bath a height equaling 0.7–10 of the depth of this section. Over the shallow part of the bath behind the sill tuyeres are mounted to deliver a gaseous reagent, oxidizing or reducing. These tuyeres should be disposed at an angle of 60°–80° to the horizontal, and directed away from the sill.

The present invention permits raising the direct extraction of non-ferrous metals in the converting process by 3–20%, ensuring the obtaining of conditioned products, and reducing the operational expenses by 10–20% as compared to the previous method of converting.

BRIEF DESCRIPTION OF THE DRAWINGS

Following is a description of an exemplary embodiment of the method of converting metallurgical melts according to the invention, with references to the appended drawings, wherein.

DETAILED DESCRIPTION OF THE PREFERRED EMBODIMENT

Figure 1:
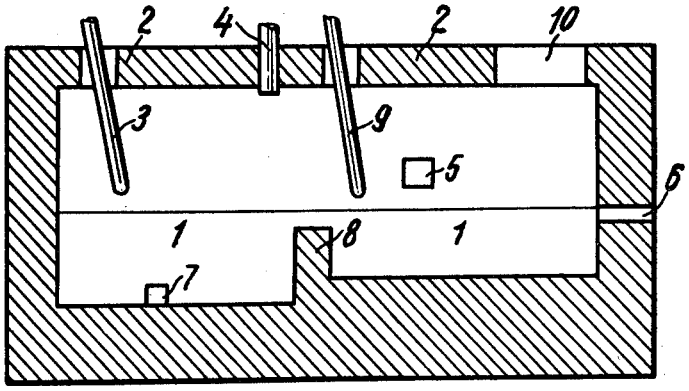
FIG. 1 shows the proposed converter furnace (longitudinal section)

The converter furnace has a bath 1 (FIG. 1) wherein the converting of the melt is carried out.

Located in the roof 2 of the furnace at an angle of 75° to the horizontal are tuyeres 3 for delivering a gaseous oxidizer, and located made in the same roof are a charging hole 4 to feed the flux, and a port 5 for supplying the starting melt.

Located in the bath are holes 6 and 7 for draining the slag and tapping the concentrated mass, respectively.

In accordance with the present invention, bath 1 of the converter furnace has a varying depth. The depth of the bath (i.e. the level height of the charged melt) the tuyeres 3 for feeding the gaseous oxidizer, and in the slag formation zone equals 1400 mm, while the bath depth in the slag separation zone is 900 mm, which is about half the bath depth under the tuyeres 3. The tuyeres 3 are directed toward the shallow part of the bath, and are spaced 100 mm from the surface of the melt charged to a specified level.

Located at the junction of depths in the bath is a sill 8, whose height in the shallow section of the bath is 850 mm, which is about 0.95 of the bath depth in this section.

The charging hole 4 to feed the flux is positioned over the deep section of the bath nearer to the overflow sill 8. Behind the sill, in the shallow part of the bath, there is located the port 5 for supplying the starting melt. Also mounted in the furnace roof 2 beind the overflow sill 8 are tuyeres 9 to feed an oxidizing or reducing gaseous reagent.

These tuyeres are disposed at an angle of 75° to the horizontal, and are directed away from the sill.

The holes 6 for draining the slag are located below the expected level of the flux layer which is created by the melt flow at the end of the bath in the slag separation zone. The holes 7 for draining the concentrated mass are located in the side wall of the bath, at the very bottom of its deep section.

At the end of the roof over the shallow part of the bath there is located a hole 10 for the exhaust gases.

Figure 2:
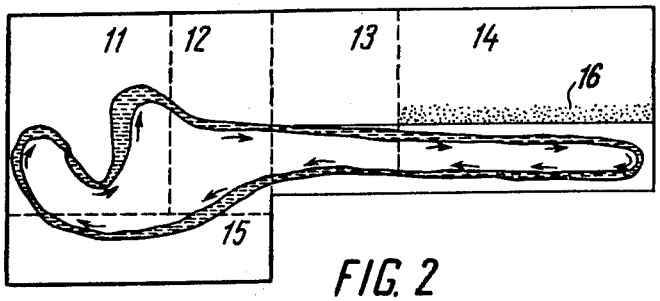
FIG. 2 is the pattern of converting the melt in a converter furnace without an overflow sill.

The converting process in the described furnace is realized as follows:

First it is helpful to consider the method of converting metallurgical melts in a bath of varying depth without any overflow sill (FIG. 2).

The starting melt is charged into the bath to a specified level, blasting being then carried out with the gaseous oxidizer, and flux being fed to the bath. The gaseous oxidizer is delivered into the deep section of the bath at an angle of 60–80° to the horizontal, and is directed towards the bath's shallow section. The oxidizer pressure is maintained within 2–10 atm, which ensures deep penetration of the jets thereof into the melt. By this method there is created in this bath of varying depth a movement of the melt in a closed vertical flow shown in FIG. 2 with a solid line. The concrete values of the oxidizer pressure are defined in each particular case by the compositions of the starting melt and the concentrated product, the furnace productivity, and other factors determining the dimensions of the bath. Increased depth and length of the bath require higher blast pressure, all other factors being equal.

With regard to the nature of processes occurring in it, the fluid bath wherein the continuous flow of the melt circulates, is conventionally divided into the following five zones: blasting zone 11, slag formation zone 12, slag washing zone 13, slag separation zone 14, and the product settling zone 15.

In the blasting zone 11, into which one or another oxidant is supplied in a directed jet, there occurs oxidation of iron sulphide, metallic iron, and other melt constituents likely to oxidize.

The typical reactions in this zone are:

$$FeS + 1\tfrac{1}{2}\,O_2 \rightarrow FeO + SO_2;$$

$$Fe + \frac{1}{2} O_2 \rightarrow FeO;$$

$$3FeS + 5O_2 \rightarrow Fe_3O_4 + 3SO_2.$$

Released here through exothermal reactions of oxidation is the main portion of heat, as well as the main mass of sulphur dioxide in the case of blasting mattes.

Generated and maintained in the blasting zone 11 due to the directed supply of the oxidizer is a continuously circulating vertically closed flow of the melt. Interaction of the oxidizing jet with the melt in this zone produces a blast crater, from which the exhaust gases and the fluid melt are being ejected.

Supplied into the slag formation zone 12 is flux which reacts with the melt constituents oxidized in the blasting zone 2, thus forming slag. The flux and melt are uniformly fed, the melt flow securing formation of a continuous flux layer 16 in the slag separation zone 14. The overoxidized constituents are partially reduced in this zone by the starting compounds.

The typical reactions in this zone are:

$$2FeO + SiO_2 \rightarrow 2FeO \cdot SiO_2;$$

$$3Fe_3O_4 + FeS \rightarrow 10FeO + SO_2.$$

Through these reactions the release of heat and gas continues, though to a lesser extent, in the slag formation zone 12. Interaction of the flux with the constituents of the melt is secured there by the intense mixing of the latter, which is due to its being immediately close to the blasting zone. Division of the mass and the slag into two layers by their specific gravities begins already to show in zone 12, although the slag layer still contains significant mechanical inclusions of the mass.

In case of necessity, for example, to utilize the excessive heat released in the blasting zone, there may be delivered into the slag formation zone 12 alongside the flux are other cold materials such as for example, lump ore, lumped concentrates, etc. In this case along with the above-described processes there takes place in zone 12 melting of the cold materials, and there may also occur reactions of thermal decomposition of the constituents of these materials, as well as of their interaction with the melt constituents, for instance, reactions of dissociation of higher sulphides:

$$2CuFeS_2 \rightarrow Cu_2S + 2FeS + S,$$

and sulphiding reactions:

$$Cu_2O + FeS \rightarrow Cu_2S + FeO.$$

Between the zones of slag formation and slag separation, i.e. in the washing zone 13, the starting melt is fed, the forming converter slag mixing here with the charged lean melt (slag washing). In this process of mixing, the exchange reactions and reactions of reduction of the oxidized slag constituents by the compounds of the starting lean melt result in extraction of valuable constituents from the slag.

The typical reactions in this zone are:

$$(MeO) + [FeS] \rightarrow [MeS] + (FeO);$$

$$(MeO) + [Fe] \rightarrow [Me] + (FeO),$$

where Me is a non-ferrous metal (Ni, Co, etc.), parentheses denoting a constituent in slag, and brackets denoting a constituent in the mass.

In the slag separation zone 14 which is covered with a floating layer of flux (flux coat) separation of the washed slag from the mass is completed. The mechanically entrained beads of the mass fall out of the slag, the depleted slag separating at the draining level. The flux layer on the melt surface promotes thermal stabilization of the bath in the slag separation zone, and in the case of a quarts flux, it secures saturation of the converter slag with silicic acid, which reduces the magnetite content in the slag, and hence, a more complete depletion of the latter. The slag is drained from under the floating flux layer.

In the product settling zone 15 the final product is collected and settled before its tapping. In melts constituting foliating systems (for example, copper sulphide - metallic copper) the settled product in zone 15 may strongly differ in its composition from the rest of the mass in zones 11 and 12. In other cases the final product in zone 15 is close to the composition of the mass in zones 11 and 12, but unlike the latter, it contains no slag inclusions.

The concentrated product is drained from zone 15.

Figure 3:
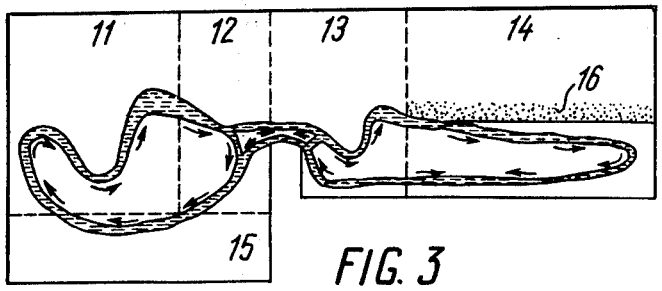
FIG. 3 is the pattern of converting the melt in a converter furnace shown in FIG. 1.

The converter furnace with an overflow sill as shown in FIG. 3, the melt in the blasting zone 11 is brought up to a heavily concentrated mass, while in zones 13 and 14 a lean composition is maintained, the melt flow at the junction of zones 12 and 13 being pressed up, for example, by means of overflow sill. This forms two closed flows of the melt circulation which exchange with each other through the general flow of the melt movement. Maintenance in zones 13 and 14 of a much leaner composition of the mass, than that in zones 11, 12, and 15, which is secured by pressing up the melt flow, provides conditions for a more complete depletion of the slag in zone 13 by its washing. According to this embodiment, with the supply of the starting melt the mass is being exchanged through the pressed up cross section of the flow, the slag from zone 12 moving against the incoming mass of the melt. The laminar contact of the slag and the mass moving in a counter-flow at a high rate developed in the constricted place, supplements the slag washing realized in zone 13.

In order to strengthen the depletion of the converter slag, or ensure thermal stabilization of the melt flow in zones 13 and 14, or for both purposes together, there may be delivered into the slag washing zone an appropriate amount of a gaseous reagent, which may constitute a part of the total required amount of the oxidizer. In other cases the gaseous reagent may be of neutral or reducing nature, or it may consist of an oxidizing and a reducing reagent.

In accordance with the composition and amount of the reagent supplied into the slag washing zone 13, the effect of slag depletion is achieved through improved mixing of the slag with the mass, and through reduction of the oxidized slag compounds by the blast constituents, while thermal stabilization of zones 13 and 14 is secured on account of heat released in the oxidation and reduction reactions of slag formation.

The proposed method of converting based on a process realized in a closed flow of the melt circulating through a series of localized zones differing in their process functions, permits successfully practising the continuous converting of metallurgical melts.

What we claim is:

1. In a method of continuously converting metallurgical melts by blowing them through with a gaseous oxidizer in a converter furnace into which a starting melt and flux are delivered, and in which in successively forming zones of oxidative blasting, slag formation, and slag separation, there are formed a concentrated product and slag to be separated, the improvement which consists of converting the melt whose depth in the zone of slag separation is less than that in the zones of oxidative blasting and slag formation, and feeding the gaseous oxidizer into the melt in the direction of the slag formation zone with the pressure of the oxidizer at the melt level being 2–10 atm, thus securing movement of the melt in a vertically closed flow through the zones of oxidative blasting, slag formation and slag separation, while feeding the flux into the slag formation zone, charging the starting melt between the zones of slag formation and slag separation, thus washing the slag through, and tapping the concentrated product at the bottom of the zone of oxidative blasting.

2. The method as claimed in claim 1, wherein by means of the melt flow, and by uniform flux charging into the slag formation zone, a continuous flux layer is produced in the slag separation zone, and draining the slag from under the flux layer.

3. The method as claimed in claim 1, wherein the converting process is realized in a converter furnace having an overflow sill at the junction of the melt depths, thus forming two closed flows of the converting melt forward of and behind the sill, these flows exchanging with each other through the general flow of the melt circulation, and feeding a gaseous reagent into this flow behind the overflow sill and forward of the slag separation zone in the direction towards the slag separation zone.

* * * * *